US006431139B1

(12) United States Patent
Hüttlin

(10) Patent No.: US 6,431,139 B1
(45) Date of Patent: Aug. 13, 2002

(54) OSCILLATING-PISTON ENGINE

(76) Inventor: Herbert Hüttlin, Rümminger Strasse 15, D-79539 Lörrach (DE)

( * ) Notice: Subject to any disclaimer, the term of this patent is extended or adjusted under 35 U.S.C. 154(b) by 0 days.

(21) Appl. No.: 09/904,816

(22) Filed: Jul. 13, 2001

Related U.S. Application Data

(63) Continuation of application No. PCT/EP00/00170, filed on Jan. 12, 2000.

(30) Foreign Application Priority Data

Jan. 14, 1999 (DE) ..... 199 01 110

(51) Int. Cl.[7] ..... F02B 53/00

(52) U.S. Cl. ..... 123/241; 123/244; 123/44 E; 123/43 C; 418/253; 418/270; 74/24; 74/52

(58) Field of Search ..... 123/241, 244, 123/44 E, 43 C; 418/253, 270; 74/24, 52, 53, 54

(56) References Cited

U.S. PATENT DOCUMENTS

| | | | | |
|---|---|---|---|---|
| 2,153,587 A | | 4/1939 | Parreira | 418/127 |
| 3,438,358 A | | 4/1969 | Porsch | 123/241 |
| 3,614,277 A | * | 10/1971 | Akira | 418/253 |
| 3,642,391 A | | 2/1972 | Wilson | 418/145 |
| 3,923,013 A | | 12/1975 | Myers | 123/241 |
| 6,009,847 A | | 1/2000 | Huttlin | 123/241 |

FOREIGN PATENT DOCUMENTS

| | | | | |
|---|---|---|---|---|
| DE | 1 526 408 | | 6/1965 | |
| DE | 1 551 101 | | 5/1967 | |
| DE | 1 401 969 | * | 1/1969 | 123/241 |
| DE | 1 576 044 | * | 7/1970 | 123/241 |
| DE | 1 936 273 | * | 1/1971 | 123/241 |
| DE | 2 226 674 | * | 5/1972 | 123/241 |
| DE | 2 234 950 | * | 1/1974 | 123/241 |
| DE | 196 39 503 C1 | | 9/1996 | |
| DE | 199 01 110 A1 | | 7/2000 | |
| EP | 103 985 A | * | 3/1984 | 123/241 |
| FR | 1 255 205 | * | 1/1961 | 123/241 |
| FR | 2 493 397 | * | 5/1982 | 123/241 |
| RU | WO 93/05319 | * | 3/1993 | 74/24 |
| SU | 1518 555 A | * | 10/1989 | 123/241 |
| WO | WO 98/13583 | | 4/1998 | |

* cited by examiner

*Primary Examiner*—Thomas Denion
*Assistant Examiner*—Thai-Ba Trieu
(74) *Attorney, Agent, or Firm*—St. Onge Steward Johnston & Reens LLC

(57) ABSTRACT

An oscillating-piston engine, comprising a housing, in which several pistons configured as two-armed levers are arranged pivotably, respectively, around a pivot axis being parallel to a central housing axis and moving commonly in a revolution direction. The pistons comprise running surfaces on a side facing away from said housing inner wall, which are guided alongside at least one control cam, when the pistons revolve in the housing, of a centrally housing-fixed cam piece, in order to control pivot movements of the pistons in the revolution. The control cam is configured as an inner contour on the cam piece, alongside of which the pistons are guided supported to a side of a centrifugal force via the running surfaces, The cam piece comprises another inner contour configured as a control cam alongside of which the pistons are guided supported to a direction of the central housing axis via the running surfaces.

18 Claims, 6 Drawing Sheets

OSCILLATING-PISTON ENGINE

CROSS REFERENCE TO PENDING APPLICATION

This is continuation of pending International application PCT/EP00/00170 filed on Jan. 12, 2000, which designates the United States and claims priority of German patent application DE 199 01 110 filed on Jan. 14, 1999.

BACKGROUND OF THE INVENTION

The invention relates to an oscillating-piston engine, comprising a housing, in which several pistons configured as two-armed levers are arranged pivotably, respectively, around a pivot axis being parallel to a central housing axis and are movable commonly in a revolution direction, wherein the pistons have running surfaces on their side facing away from a housing inner wall, the running surfaces when the pistons revolve in the housing, being guided alongside of at least one control cam of a central housing-fixed cam piece, in order to control the pivot movements of the pistons in revolution.

Such a oscillating-piston engine is known from WO 98/13583, the disclosure of which is herewith explicitly included into the present application.

Oscillating piston-engines belong to a type of internal combustion engines, in which the single working strokes of intake, compression, ignition (expanding) and expulsion of the combustion mixture are mediated by rock-like pivot movements of the single pistons between two end positions.

The known oscillating piston-engine has centrally in the housing a housing-fixed cam piece, which comprises an outer contour configured as a control cam. The pistons have running surfaces on their sides facing away from the housing inner wall, i.e. on their sides facing the central cam piece, the running surfaces being guided, when the pistons revolve in the housing alongside the outer contour of the cam piece, in steady contact with same. The pivot movements of the pistons are controlled in this procedure, when the pistons revolve in the housing, by the guiding of the running surfaces of the pistons alongside the outer contour of the cam piece in combination with a rolling engagement of respectively adjacent pistons.

Although the known oscillating piston-engine has turned out to be particularly favorable for what concerns its running characteristics, it can be improved for what concerns its wear-resistance and fail-safety, in particular in long-term operation and in high performance operation.

Calculations with respect to kinematics of the known oscillating piston-engine have, namely, shown that the centrifugal forces of the oscillating pistons adopt different values between a minimum and a maximum, seen via a full revolution in dependence of the momentous rotation position, which is to be explained by the asymmetric mass position of the oscillating pistons with respect to the center of the pivot axes of the single pistons.

The maximal centrifugal force occurs in each piston when it is in the so-called Upper-Dead-Center (TO) position (12 o'clock position) or in the Bottom-Dead-Center (UT) position (6 o'clock position). This maximal centrifugal force acting on the leading lever arm of the piston being in the TO position, which presses this lever arm to the outward into the direction of the housing inner wall, results in a force of equal amount directed to the cam piece acting on the trailing lever arm of the same piston. As this trailing lever arm is in rolling engagement with the leading lever arm of the next trailing piston, the trailing lever arm of the leading piston presses the leading lever arm and, thus, the running surface arranged on that lever arm with increased force against the cam piece. This is because only a centrifugal force minimum acts upon on the leading lever arm of the trailing piston, which is just in the drawn-in 9 o'clock position or 3 o'clock position, so that this minimal centrifugal force does not compensate the compressive force caused by the centrifugal force in the TO position. The consequence is that the running surface of the trailing piston in the 9 o'clock position or of the piston in the 3 o'clock position is pressed against the cam piece with very high force, whereby both the running surface and the cam piece are excessively loaded.

In long-term operation, this may result in increased wear or even in damage of these parts, in particular when the rotational speed is high and, therefore, the centrifugal forces are high.

It can be seen from the above that the teething of the rolling engagement, which has to absorb opposing forces, is even more force loaded.

Moreover, a centrifugal piston combustion engine is known from DE-OS-15 51 101, which comprises six pistons of an approximately triangle form distanced from each other, which are mounted, pivotably, on a circle-shaped driving wheel such that they are pressed against the inner wall of the housing by the occurring centrifugal forces, when rotating in the housing of the engine. The control of the pivot movement of the single pistons is, in this procedure, caused by a special trochoid-shaped embodiment of the housing inner wall. In the housing, moreover, two stationary guiding cams with an outer contour are arranged, which are to guarantee, at low speed of the engine, when the centrifugal forces are low, that the pistons are pressed against the inner wall of the housing to guarantee working of the engine, when the speed is low. This centrifugal piston engine is disadvantageous, however, already because of the required special noncircular contour of the housing inner wall.

From DE-OS-15 26 408, a combustion engine with revolving pistons which form a closed chain is further known. The pistons form, together with the noncircular, approximately oval cylinder jacket, closed rotating working chambers of changeable volume. The articulation polygon formed by the pistons is a pentagon or a polygon, whereby a regular pentagon is considered as to be the most advantageous. For the control of the piston movement, two auxiliary rotors are provided, which consist of five segments, these segments being articulatedly connected via bolts. On the bolts, rollers are mounted, which, rolling over the race, control the movement of the rotors and by means of further bolts the movement of the pistons, too. This embodiment of an oscillating-piston engine is relatively expensive. Further disadvantages of this embodiment are the noncircular configuration of the housing inner wall and the articulated connection of the segments forming the two auxiliary rotors for controlling the pivot movement of the pistons.

From U.S. Pat. No. 3,642,391, another oscillating-piston engine is known, in which the pistons are in pairs articulatedly connected to each other. The form of the housing inner wall of this oscillating-piston engine is not round, but elliptical. The piston pivot movements are controlled by cam pieces, on which the pistons run with rollers. Also in this oscillating-piston engine, the noncircular contour of the housing inner wall is disadvantageous.

It is therefore an object of the invention to improve an oscillating-piston engine mentioned at the outset in such a way that the disadvantages mentioned before are avoided. The oscillating-piston engine is to be improved with reference to its wear characteristics and fail-safety.

SUMMARY OF THE INVENTION

According to the invention, this object is achieved by an oscillating piston engine, comprising:

a housing having a central housing axis and a housing inner wall;

several pistons configured as two-armed levers, said pistons being arranged in said housing and moving/orbiting together in a revolution direction about said central housing axis;

several pivot axes parallel to said housing axis, each of said pistons arranged pivotably about one of said pivot axes, respectively;

a stationary cam piece with respect to said housing and arranged centrally in said housing, said cam piece having an outer contour and at least one inner contour, said outer contour and said inner contour being configured as control cams, wherein said pistons have, at a side facing away from said housing inner wall, running surfaces, which are guided alongside said inner contour supportedly to a side of a centrifugal force and alongside said outer contour supportedly into a direction of the housing axis, in order to control pivot movements of said pistons in the revolution about said central housing axis.

The oscillating-piston engine of the invention, thus, further assumes that the pivot movements of the single pistons when revolving are controlled by a housing-fixed central cam piece, which has proved to be advantageous compared to the known centrifugal piston combustion engine. In the oscillating-piston engine, however, in form of the control cam configured as inner contour, alongside of which the running surfaces of the pistons are guided, a measure has been taken in order to absorb the centrifugal forces of the piston halves or lever arms of the pistons. As the control cam configured as inner contour absorbs the centrifugal forces, it is avoided that the centrifugal forces, in particular the maximal centrifugal forces occurring in the TO position, are transmitted, over the rolling engagement onto the running surface or running surfaces of the respective leading and trailing piston and onto the cam piece. In this way, overload of the running surfaces and of the cam piece is avoided. Another advantage resulting from the embodiment of the cam piece according to the invention is that also the forces in the region of a rolling engagement between adjacent pistons, if such a rolling engagement exists, are also reduced in an advantageous manner.

The cam piece further has another outer contour configured as control cam, alongside of which the same running surfaces or other running surfaces of the pistons, the running surfaces being also arranged on the side facing away from the housing inner wall on the pistons, are guided supported into the direction of the housing axis.

In this measure, each piston experiences both an "outer guiding" alongside of the known per se outer contour and, additionally, an "inner guiding" alongside the inner contour of the cam piece. Such a combination of inner guiding and outer guiding allows a kinematically exact and, at the same time, a dynamically favorable control of the pivot movements of the pistons when rotating in the housing, whereby reaching the important advantage that the running surfaces in the position 9 o'clock and 3 o'clock are compression relieved in comparison to the known oscillating-piston engine. Another advantage of the combination of an inner guiding and an outer guiding is that in a rolling engagement of respective adjacent pistons this rolling engagement has essentially no control function any more, but has merely the function of a sealing. This offers the possibility to configure the rolling engagement in form of a smooth rolling surface instead in form of a teething, or even omit a rolling engagement, as is provided in a preferred embodiment.

In a preferred embodiment, the outer contour and the inner contour run parallel to each other.

In this embodiment, the inner contour and the outer contour have curve courses essentially complementary to each other. Each piston is, thus, guided both centrifugally and centripetally, like on a rail. The embodiment of the inner contour being parallel to the outer contour has the advantage that it is possible to modify with simple means the oscillating-piston engine known and proven from WO 98/13583 according to the present invention. For example, the piston geometry and the geometry of the outer contour of the cam piece can be kept essentially unchanged, whereby, then, merely on the cam piece an inner guiding surface for the pistons needs to be provided.

In another preferred embodiment, the inner contour is configured continuous in revolution direction.

It is here of advantage that each piston is supported over a full revolution to the side of the centrifugal force, i.e. centrifugally, so that in each rotation position of the pistons centrifugal forces are absorbed and, thus, compression stress is reduced in each rotation position.

Alternatively it is also preferred, however, in the case of an embodiment with an inner contour and an outer contour if the inner contour extends only over one or more circumferential sections in the revolution direction.

In this way, a simpler configuration of the oscillating-piston engine can be reached, whereby it is preferred in this case, if the inner contour extends at least in the region of the Upper-Dead-Center and of the Bottom-Dead-Center, for instance, from 10 o'clock until 2 o'clock and from 4 o'clock to 8 o'clock.

In another preferred embodiment, the cam piece has the outer contour and the at least one inner contour in a one-piece configuration.

In this embodiment, the cam piece can be, altogether, in one piece, whereby the manufacturing costs and the number of the parts entering the construction can be reduced. Proceeding from the cam piece of the known oscillating-piston engine, the inner contour provided according to the invention can be formed in the manufacture of the cam piece. Another advantage of a one-piece configuration of the outer contour and the inner contour is that a stable orientation of the two contours is guaranteed in the long run during the operation of the oscillating-piston engine.

Alternatively to that embodiment, it is also preferred, however, to have the cam piece configured in several parts, wherein at least a first part has the control cam configured as outer contour and at least a second part has the at least one control cam configured as inner contour, and the parts are firmly connected to each other.

This embodiment proves to be advantageous because of facilitated mounting when joining the running surfaces of the pistons with the cam piece. The inner contour can here be configured on a ring flange which is flanged onto the remaining cam piece comprising the outer contour.

In another preferred embodiment, the inner contour is arranged on an inner side of bag-like flanges of the cam piece.

This measure is particularly advantageous both from the manufacture point of view and of the mounting point of view. If the cam piece comprises both the inner contour and the outer contour, the flange or the flanges can be configured in one piece with the other part of the cam piece comprising the outer contour, or as separate ring flanges, which are, then, connected positively to the other part of the cam piece comprising the outer contour, the positive connection being, for instance, a connection by pins. The bag-like flanges form an approximately reversed L-shaped overlapping of these running surfaces, which are provided for the guiding at the inner contour.

In another preferred embodiment, the cam piece has, in the region of both axial ends of the pistons, respectively, axially limited, the inner contour.

In this embodiment, each piston is, thus, guided with its both axial ends on the side of the centrifugal force. The axially central region of each piston can, then, if provided, have the running surfaces, which are radially guided, at the outer contour, supported to the inner side.

If the cam piece comprises both the inner contour and the outer contour, it is further preferred, if each piston comprises at least two running surfaces, at least one of which is guided at the inner contour, while the at least one further running surface is guided at the outer contour.

This embodiment offers advantageously the possibility to realize the running surfaces by rollers, whereby, then, the at least one roller being guided alongside the inner contour can freely roll on the inner contour and the at least one roller being guided at the outer contour can also freely roll on the outer contour.

In another preferred embodiment, the running surfaces are surfaces of rollers being rotatably mounted on the pistons.

Rollers have the advantage that they can be guided with an essentially less friction alongside the inner contour and/or alongside the outer contour of the cam piece. The demands on the lubrication of the running surfaces can be considerably reduced in comparison to piston-fixed slide shoes.

In another preferred embodiment, the pistons are, respectively in pairs, in rolling engagement with each other.

This measure is advantageous in the case that the pistons are guided only alongside the inner contour, but, however, not alongside the outer contour, so that the rolling engagement can, then, take over an additional control function for the to and fro pivot movement of the pistons.

In another preferred embodiment, the pistons are, respectively in pairs, in rolling engagement with each other via an unteethed curved rolling surface.

As already mentioned before, the forces are reduced in the region of the rolling engagement of adjacent pistons by the guiding of the pistons according to the invention alongside the inner contour and even stronger in an additional guiding of the pistons alongside the outer contour, so that the rolling engagement has mainly a sealing function. According to that, the rolling engagement can also be represented as a smooth rolling surface, which is easier to manufacture than a teething.

Alternative to a rolling engagement of respectively adjacent pistons, it is equally preferred if the pistons, seen in circumferential direction, are spaced, respectively, in pairs via a respective dividing element, wherein the dividing elements revolve together with the pistons in the housing.

This embodiment is in particular in an advantageous way possible, when the pivot movement of the single pistons is both performed via the inner outer guiding and via the outer inner guiding of the cam piece. The single pistons are, then, because of the no more existing rolling engagement, completely independent of each other, with the advantage that at the surface between piston and dividing element in a constructively simple manner seals of common type can be used.

In this measure, it is further preferred if each dividing element has two sliding surfaces, on which piston fist surfaces of the two respective corresponding pistons being in contact with the respective dividing element slide to and fro during their pivot movement.

The dividing elements are, thus, preferably stationary with respect to the pivot movement of the pistons, and revolve merely with the pistons in the housing in the revolution direction.

The dividing elements can be firmly clamped between two annular elements moving with the pistons at the respective end face of the oscillating-piston engine.

The piston fist surfaces of the pistons can be configured e.g. in a convex fashion and the sliding surfaces of the dividing elements can be configured in a concave fashion, or vice versa. Such a curved forming of the piston fist surfaces and sliding surfaces sliding in contact with each other is optimally adjusted to the pivot movement moving to and fro of the single pistons. The complementary forming of the piston fist surfaces and of the sliding surfaces further allow an optimal sealing of the work chambers against the oil space of the oscillating-piston engine via the whole pivot stroke, if the dividing elements extend, in axial direction, over the length of the interior of the housing of the oscillating-piston engine.

In this measure, it is preferably provided to arrange at least one seal in each sliding surface of the dividing elements, respectively.

Such sealings can be provided in the form of sealing lips, which are arranged in the same place where the corresponding sealing lips are arranged next in the ring sides at the face of the piston cage of the longitudinal central axis of the oscillating-piston engine.

The arrangement of the seals in the dividing elements is, however, not imperative, the seals may as well be arranged in the piston fist surfaces of the pistons instead of in the dividing elements.

In another preferred embodiment, in each sliding surface a fire seal nearer to the housing inner wall and an oil seal nearer to the cam piece is arranged.

The fire seal seals gas-tight the work chambers, where the combustion process takes place, while the oil space arranged centrally in the oscillating-piston engine is additionally sealed via the oil seal against the work chambers.

In another preferred embodiment, the oscillating-piston engine has several chambers in axial direction, wherein in each chamber a set of pistons is arranged, and wherein the sets of pistons are displaced to each other from chamber to chamber in circumferential direction.

While the known oscillating-piston engine is configured as one-chamber-system in axial direction, the multi-chamber embodiment has the advantage that the torques passed by the piston onto the cam piece can be halved or divided into thirds or divided even further, corresponding to the number of the chambers because the torque-effective surface of the pistons can be configured correspondingly smaller in axial direction. By displacing the piston sets from one chamber to the next chamber, the torque transmission onto the central cam piece is more regularly distributed in circumferential direction. In that way, the smoothness of running of the oscillating-piston engine can be increased in an advantageous way, and the load of the cam piece, which can be configured continuous through all chambers in one piece or in several parts, can further be reduced.

Further advantages can be taken from the description and the enclosed drawings.

It is to be understood that the features mentioned above and those yet to be explained below can be used not only in the respective combinations indicated, but also in other combinations or in isolation, without leaving the scope of the present invention.

BRIEF DESCRIPTION OF THE DRAWINGS

Embodiments of the invention is shown in the drawings and will be explained in more detail in the description below. In the drawings.

DETAILED DESCRIPTION OF PREFERRED EMBODIMENTS

Figure 1:
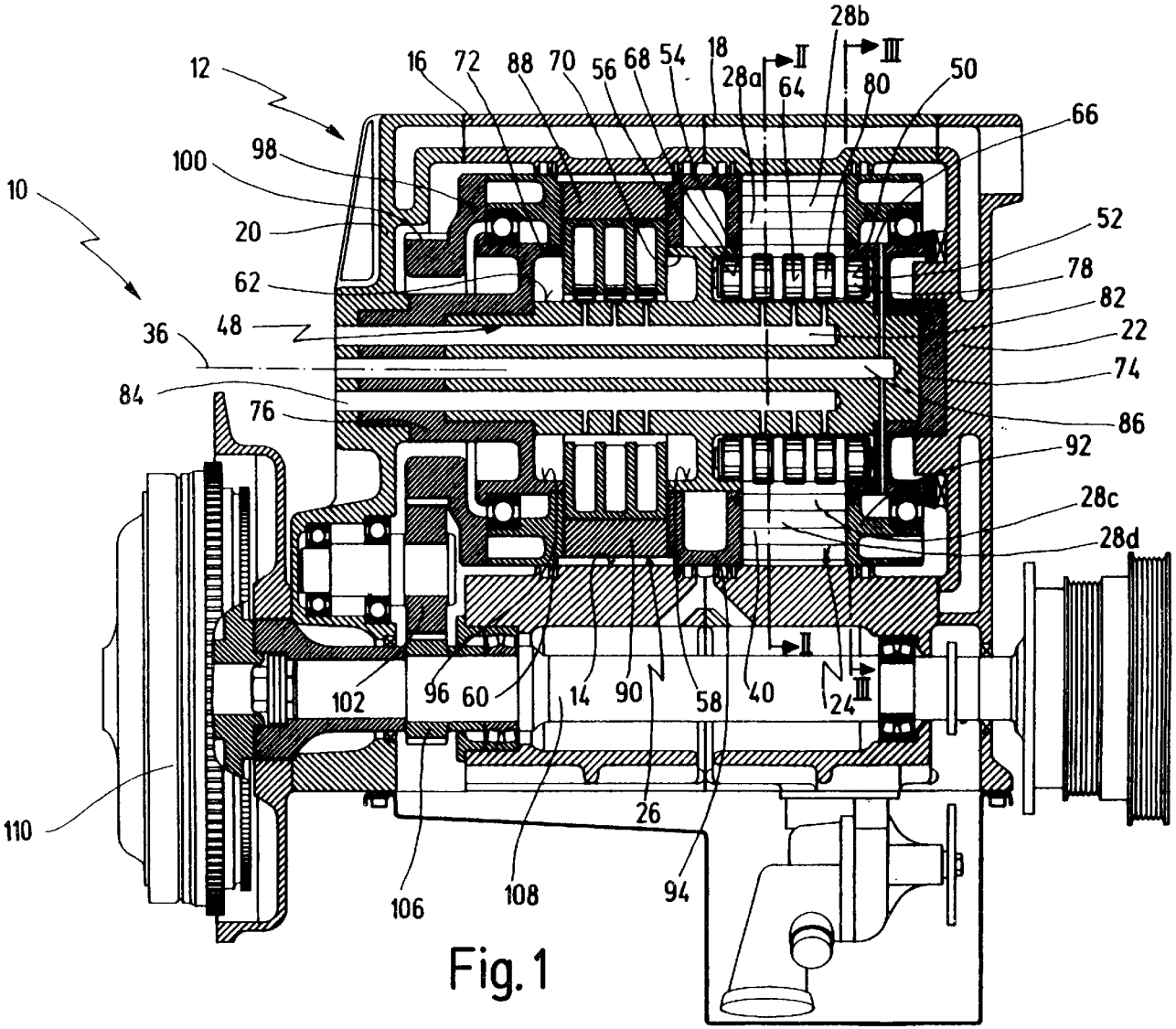
FIG. 1 shows a longitudinal section through an oscillating-piston engine according to a first embodiment.
Figure 2:
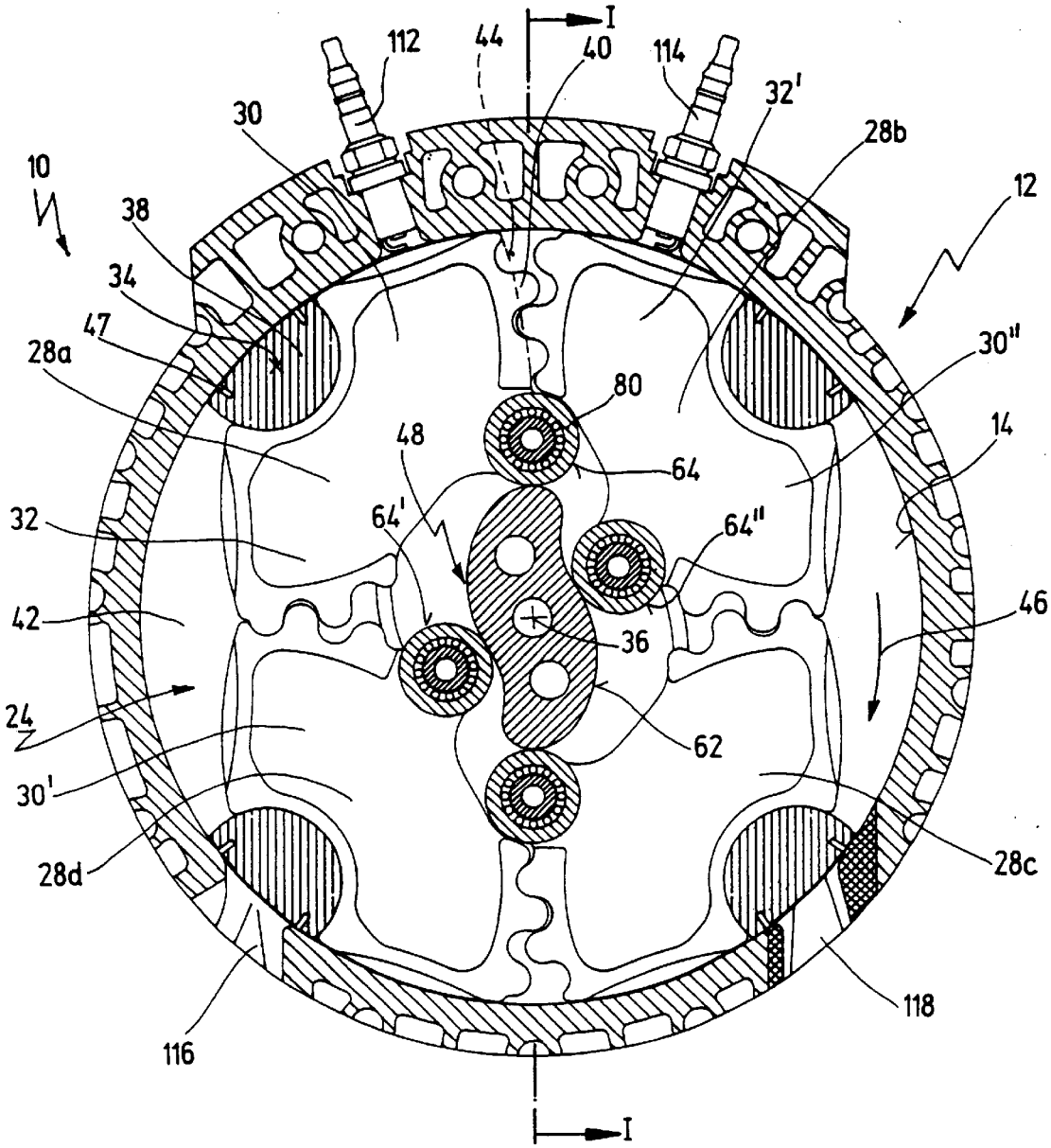
FIG. 2 shows a cross section along line II—II in FIG. 1.
Figure 3:
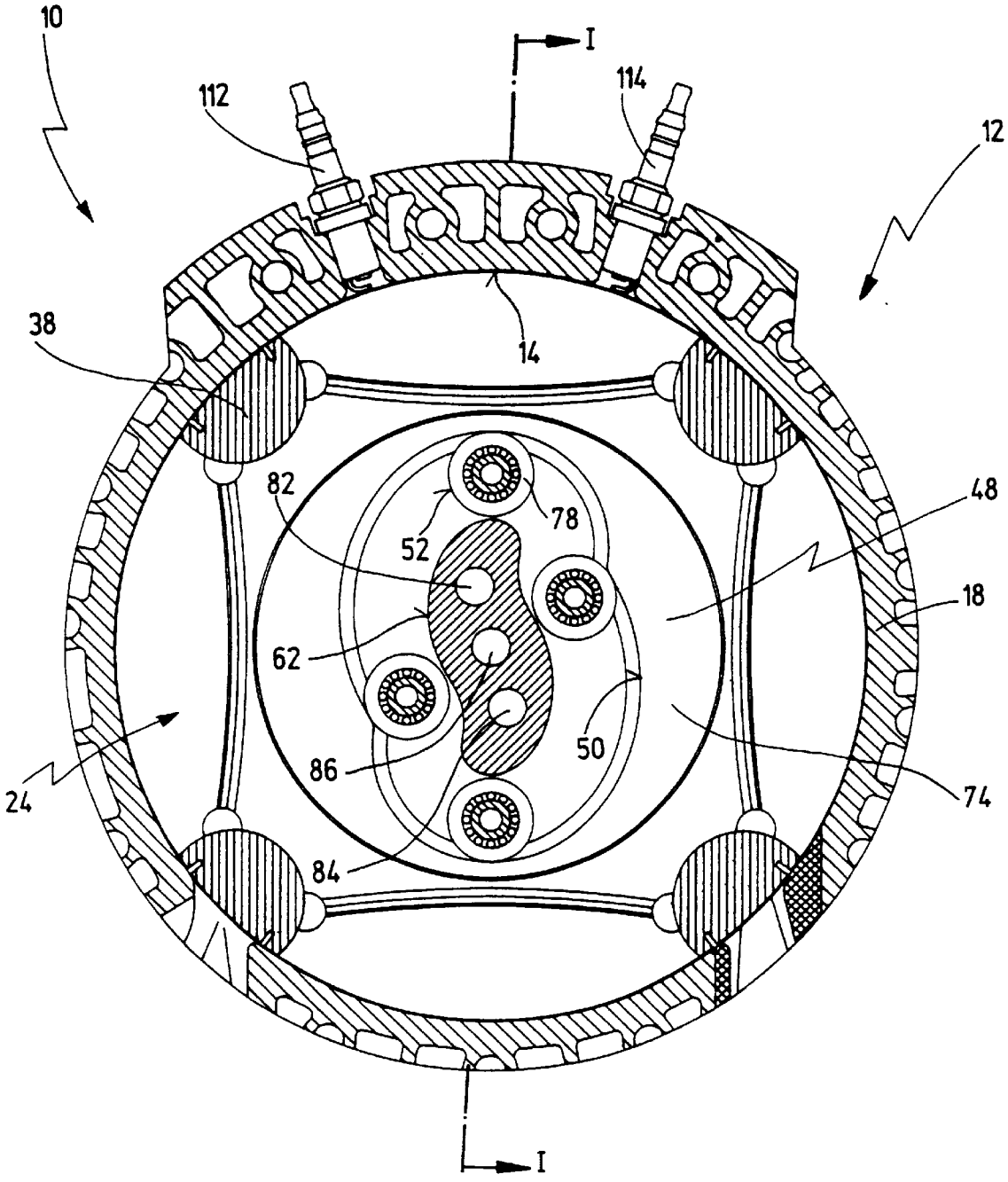
FIG. 3 shows a cross section through the oscillating-piston engine along line III—III in FIG. 1.

In FIGS. 1 to 3, an oscillating-piston engine provided with the general reference numeral 10 is shown. Oscillating-piston engine 10 is used, for example, in a motor vehicle as a combustion engine.

Oscillating-piston engine 10 has circumferentially a housing 12, which seals oscillating-piston engine 10 to the outward. Housing 12 is mainly configured cylindrically, i.e. round in the cross section, and extends over the axial length of oscillating-piston engine 10. A housing inner wall 14 is configured axially continuously round in the cross section.

Housing 12 is further, as shown in FIG. 1, constructed of single housing segments, namely, of cylindrical housing segments 16 and 18 and of housing end face segments 20 and 22, which are, respectively, connected to each other in a suitable manner, for example, connected by pins and/or screwed. Due to the assembly of housing 12 in single housing segments, the mounting of oscillating-piston engine 10 is considerably facilitated and allows a module type in the case of a multi-chamber-system.

In axial direction, oscillating-piston engine 10 is divided into two chambers 24 and 26.

In each of the chambers 24 and 26, respectively, a set of pistons is arranged, with FIG. 2, which is a cross section through chamber 24, showing pistons 28*a* to 28*d* of chamber 24. Four pistons 28*a* to 28*d* are thus, respectively, arranged in both chambers 24 and 26. The pistons are arranged identically with the pistons of chamber 26, which are not shown in detail, so that, in the following, only chamber 24 with pistons 28*a* to 28*d* being arranged in it will be closer described.

It is true that the pistons of chamber 26 are arranged identically with pistons 28*a* to 28*d* of chamber 24, the pistons of chamber 26, however, are arranged with reference to pistons 28*a* to 28*d* of chamber 24 displaced by approximately 45°, seen in circumferential direction.

Pistons 28*a* to 28*d* are, respectively, configured as two-armed levers, i.e. each of pistons 28*a* to 28*d* has a first lever arm 30 and a second lever arm 32 with reference to a pivot axis 34, which are designated exemplary for piston 28*a* in FIG. 2. Each of pistons 28*a* to 28*d* is, thus, allocated to a pivot axis 34. Pivot axes 34 lie on a circle with the same distance to each other.

Each of the four pivot axes 34 extends in axial direction parallel to a central housing axis 36. Pistons 28*a* to 28*d* are, respectively, pivotable to and fro, between two end positions, about their respective pivot axis 34, wherein in the first end position respective lever arm 30, with its outer side, is in contact with housing inner wall 14 and in the second end position, respectively, respective lever arm 32, with its outer side, is in contact with housing inner wall 14.

To this end, each of pistons 28*a* to 28*d* is mounted pivotably about an axially extending journal rod 38, which is, itself, not pivotable. Each journal rod 38 forms the respective pivot axis 34 of the single pistons 28*a* to 28*d*.

Pistons 28*a* to 28*d* still are, respectively, in pairs with each other in rolling engagement. To this end, pistons 28*a* to 28*d* have, respectively, in circumferential direction, teethings 40 at both ends, which mesh mutually with each other. Piston 28*a* is, thus, in rolling engagement both with piston 28*b* and with piston 28*d*. The rolling engagement formed by teething 40 is, in this operation, tight, so that work chambers 42 formed between housing inner wall 14 and the outer sides of pistons 28*a* to 28*d* being opposite to housing inner wall 14 are hermetically sealed by the rolling engagement.

Instead by means of teething 40, the single pistons 28*a* to 28*d* may also be in rolling engagement with each other via a convexly curved rolling surface 44, which is shown with broken lines in FIG. 2, wherein, then, adjacent ones of rolling surfaces 44 in each pivot position of pistons 28*a* to 28*d* are sealingly in contact with each other, in order to guarantee, again, the hermetic seal of work chambers 42.

Pistons 28*a* to 28*d* further revolve commonly in housing 12 in a revolution direction 46 about central housing axis 36. Journal rods 38, which also revolve, are, in this operation, sealed against housing inner wall 14, and such by means of centrifugal force sealings 47, as described in detail in WO 98/13583, to which reference is made for a more detailed description.

Between respectively two adjacent of journal rods 38, the corresponding section of the housing inner wall and two adjacent lever arms 32 and 30', hence, respectively, one of work chambers 42 is formed, in the shown embodiment with four pistons 28*a* to 28*d* accordingly four work chambers 42 in revolution direction 46, which are sealed to each other. The volume of work chambers 42 changes when the pistons 28*a* to 28*d* revolve corresponding to the to-and-fro pivot movements of the pistons 28*a* to 28*d* to allow the different work cycles of intake, compression, ignition (expanding) and expulsion.

A cam piece 48 is arranged centrally in housing 12, which extends through chamber 24 and through chamber 26. Cam piece 48 is configured housing-fixed in comparison to pistons 28*a* to 28*d*.

Cam piece 48 has at least one inner contour 50 configured as control cam (cf. FIG. 3).

Pistons 28*a* to 28*d*, on their part, have running surfaces 52 on their side facing away from housing inner wall 14 and facing cam piece 48, the running surfaces being guided when pistons 28*a* to 28*d* revolve in housing 12, along inner contour 50 configured as control cam. In this way, pistons 28*a* to 28*d* are guided supported to the side of the centrifugal force along cam piece 48.

Inner contour 50 is arranged on cam piece 48 in the region of an axial end of pistons 28*a* to 28*d*.

A second inner contour 52, which is identical to inner contour 50 for what concerns the course of the curve and which is configured as control cam, is arranged on cam piece 48 in the area of opposite axial end of pistons 28*a* to 28*d*. At this end, pistons 28*a* to 28*d* have, respectively, another running surface 54, which is guided along inner contour 52 of cam piece 48, while the respective piston 28*a* to 28*d* revolves.

In chamber 26, cam piece 48 has inner contours 56 and 58, which are also configured as control cams and correspond to inner contours 50 and 52, inner contours 56 and 58 being provided for guiding, supported to the side of the centrifugal force, corresponding running surfaces of the pistons arranged in chamber 26, which pistons are not designated in detail.

In the region between inner contours 50 and 52 and between inner contours 56 and 58, cam piece 48 further has an outer contour configured as a control cam. Outer contour 62 extends here axially until into the region of inner contours 50, 54, 58, 60 or ends already axially central between inner contours 50 and 54 or 58 and 60.

Pistons 28*a* to 28*d* have each at least one further running surface 64, which are guided in housing 12 along outer contour 62 of cam piece 48, when pistons 28*a* to 28*d* revolve, whereby pistons 28*a* to 28*d* are also each supported radially to the inward with respect to central housing axis 36.

In the embodiment, each piston 28*a* to 28*d* has three running surfaces 64, which are axially spaced from each other, and which are commonly guided along outer contour 62 of cam piece 48.

Inner contours 50, 54, 58 and 60 of cam piece 48 are each configured on an inner side of a flange 66, 68, 70 and 72, which forms a bag.

In this operation, flanges 68 and 70, which form inner contours 54 and 58 on their radial inner side, are configured in one piece with the remaining body of cam piece 48. Flanges 66 and 72 are, however, configured on ring flanges 74 or 76, which are positively connected to the remaining body of cam piece 48 and firmly connected by pins to it. Ring flanges 74 and 76 are still, on their respective axial outer side, connected housing-fixed with housing end face segment 20, so that ring flanges 74 and 76 form a housing-fixed arrangement with the remaining body of cam piece 48.

Running surfaces 64, which are guided along outer contour 62 and running surfaces 52 and 56, which are guided along inner contours 50 or 54, are each surfaces of rollers 78 or 80, which are rotatably mounted on pistons 28*a* to 28*d*. Rollers 78, each piston 28*a* to 28*d* has two of which, are, in this operation, solely in contact with inner contour 50 or 54, while rollers 80, each piston 28*a* to 28*d* has three of which, are solely in contact with outer contour 62.

Running surfaces 64 are in steady touch with outer contour 62 when pistons 28*a* to 28*d* revolve. Running surfaces 52 and 56 are in steady touch with inner contour 50 or 54, when pistons 28*a* to 28*d* revolve.

With reference to FIG. 3, it is to be mentioned that running surfaces 52 of rollers 78 are not in touch with outer contour 62 of cam piece 48, but are spaced from this outer contour with a slight clearance, so that rollers 78 can roll freely on inner contour 50 of cam piece 48, when pistons 28*a* to 28*d* revolve.

Rollers 78 and 80 are, to this end, preferably mounted on a common bolt, which axially passes through rollers 78 and 80. Running surfaces 54 and 52 of rollers 78 are in steady touch with inner contour 50 guided along inner contour 50, while pistons 28*a* to 28*d* revolve, while running surfaces 64 of rollers 80 are guided in steady touch with outer contour 62 of cam piece 48 along this outer contour, while pistons 28*a* to 28*d* revolve.

As can be seen in FIG. 3, inner contour 50 extends in circumferential direction in full circumference at cam piece 48.

Together with ring flanges 74 and 76, cam piece 48 is, altogether, configured in several parts, whereby the mounting of oscillating-piston engine 10, more exactly the insertion of pistons 28*a* to 28*d* and the assembly with cam piece 48, is facilitated.

In FIG. 2 and 3, oscillating-piston engine 10 is shown in an operating position, in which piston 28*a*, or more exactly, its lever arm 30 leading in revolution direction 46, is located in the Upper-Dead-Center (TO). Piston 28*d* trailing after piston 28*a*, i.e. more exactly leading lever arm 30 of piston 28*d*, is located, however, in its position contracted maximally radially to the inward. A maximal centrifugal force acts upon leading lever arm 30 of leading piston 28*a* when rotating, in particular when the speed is high. This maximal centrifugal force is, however, absorbed by inner contour 50, via running surfaces 52 or 56, which are guided at inner contour 50 of cam piece 48. In that way, this high centrifugal force is not transmitted, via trailing lever arm 32 of leading piston 28*a*, onto leading lever arm 30' of trailing piston 28*d*, which is in the 9 o'clock position, so that running surface 64' or running surfaces 64' of piston 28*d* are not pressed excessively against cam piece 48. In the same way, this centrifugal force is not transmitted onto trailing lever arm 32' of leading piston 28*b* and, thus, is also not transmitted as compressive force on its leading lever arm 30", which is in 3 o'clock position, so that also its running surface is relieved of pressure.

Cam piece 48 further has bores 82, 84 and 86 extending axially, which are provided for the mist coolant system and the oil lubrication of running surfaces 50, 54 and 64 of pistons 28*a* to 28*d* and for the lubrication of rollers 78, 80.

As already mentioned at the outset of the description, oscillating-piston engine 10 is configured, in axial direction, as multi-chamber system, in the embodiment shown more exactly as two-chamber system.

The pistons arranged in chamber 26, which are not described in detail in the drawings, have the same configuration as pistons 28*a* to 28*d* of chamber 24 with reference to their guiding along cam piece 48.

The pistons of chamber 26 are also mounted pivotably at journal rods, two journal rods 88 and 90 of which of opposite pistons are shown. Journal rods 88, 90 and the two other journal rods which cannot be seen in the drawings, are displaced by approximately 45° with reference to journal rods 38, on which pistons 28*a* to 28*d* of chamber 24 are pivotably mounted.

Journal rods 38 of chamber 24 and journal rods 88, 90 and the other two journal rods of chamber 26 form together with three annular elements 92, 94 and 96 a rigid cylindrical piston cage, which revolves together with pistons 28*a* to 28*d* of chamber 24 and, commonly, with the pistons of chamber 26. Journal rods 38 of chamber 24 are firmly connected to annular elements 92 and 94, while all journal rods 88, 90 of chamber 26 are firmly connected to annular elements 94 and 96. First annular element 92 is mounted, in this operation, rotatably and tightly on ring flange 74 of cam piece 48. Correspondingly, third annular element 96 is mounted rotatably and tight on ring flange 76 of cam piece 48. Central annular element 94 is mounted rotatably on the outer sides of flanges 68 and 70 of cam piece 48.

Third annular element 96 carries on its axially outer side a toothed ring 98, which has an outer teething, which meshes with a corresponding teething of a change gear wheel 102, which, again, meshes with a corresponding teething 104 of a toothed ring 106, which is nonrotatably connected to an output shaft 108 of oscillating-piston engine 10. The rotation of third annular element 96 about central housing axis 36 causes, thus, a rotation movement of output shaft 108, which can then be transmitted, via a clutch disk 110, into a drive line of the motor vehicle, in which oscillating-piston engine 10 is built in.

Oscillating-piston engine 10 further has spark plugs 112 and 114 for each chamber 24, 26, and a respective inlet cross section 116 and a respective outlet cross section for each chamber 24 and 26.

Figure 5:
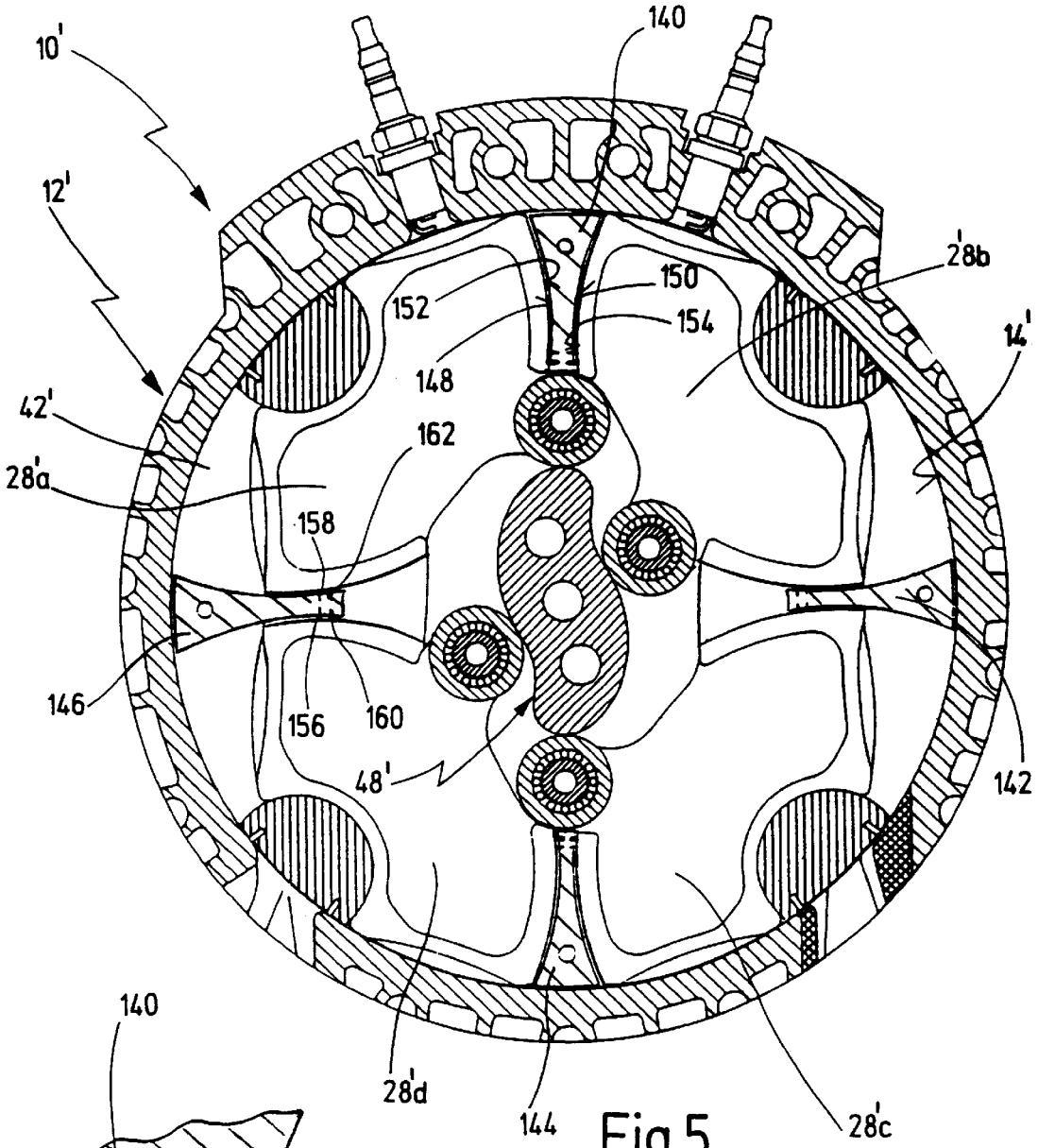
FIG. 5 shows a cross section through the oscillating-piston engine along line V—V in FIG. 4.

For what concerns the function of the oscillating-piston engine, reference is made to WO 98/13583, in which the single work strokes of oscillating-piston engine 10 are shown in FIG. 5.

Figure 4:
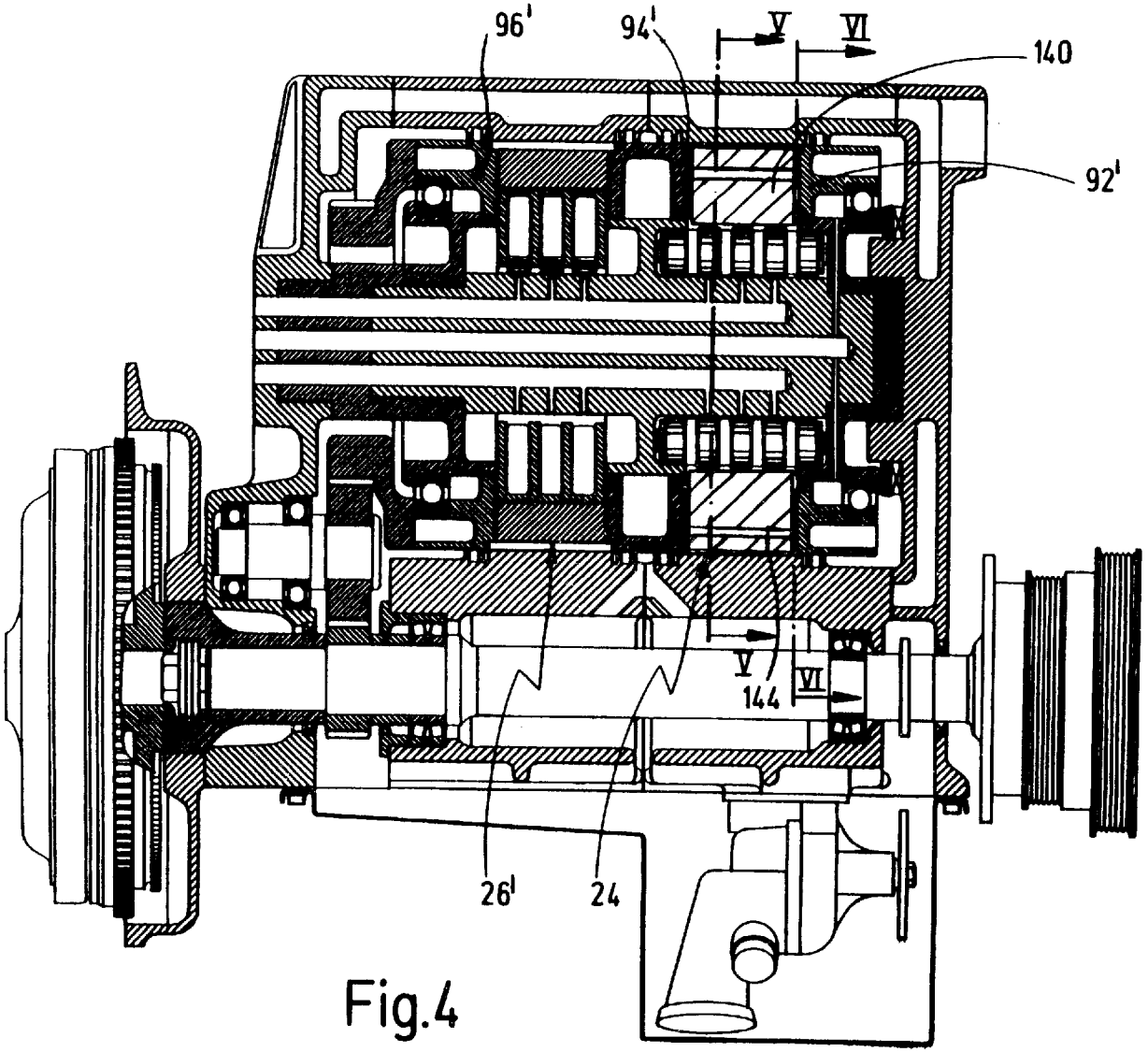
FIG. 4 shows a longitudinal section through an oscillating-piston engine according to the invention according to a second embodiment, which is slightly modified in comparison to the first embodiment.
Figure 6:
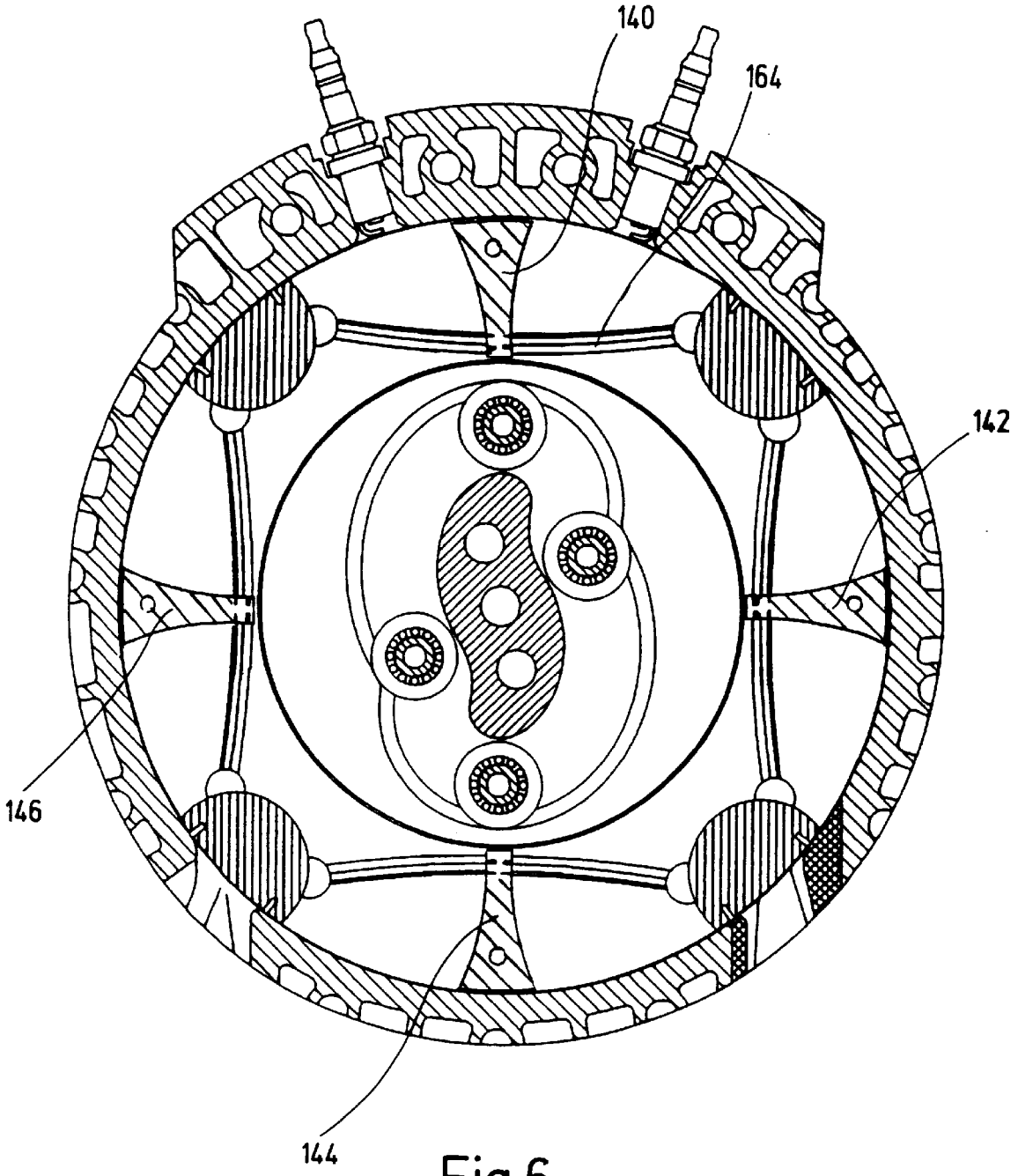
FIG. 6 shows a cross section through the oscillating-piston engine along line VI—VI in FIG. 4.

In FIG. 4 to 6, an embodiment of an oscillating-piston engine 10' is shown, which is slightly modified compared to oscillating-piston engine 10 according to FIGS. 1 to 3, the differences of which with respect to oscillating-piston engine 10 according to FIGS. 1 to 3 are only described. The same or similar features as in oscillating-piston engine 10 were provided with the same reference numeral followed by an apostrophe.

Features and functions of oscillating-piston engine 10', to which reference is not explicitly made, are identical with those of oscillating-piston engine 10.

Whereas in oscillating-piston engine 10, according to FIG. 1 to 3, pistons 28*a* to 28*d* are, respectively, in rolling engagement with each other in pairs, pistons 28*a*' to 28*d*' of oscillating-piston engine 10' are, seen in circumferential direction, respectively, in pairs, spaced by a respective dividing element 140, 142, 144, 146, whereby dividing elements 140, 142, 144, 146 with pistons 28*a* to 28*d*' revolve in the housing 12'.

Four dividing elements 140 to 146 extend, according to FIG. 4, over the axial length of the chamber 24', and corresponding dividing elements between the pistons in the chamber 26' also extend over the axial length of this chamber 26'.

Dividing elements 140 to 146 are clamped between annular elements 94' and 92' and/or 96' and 94' and unrotable relative with respect to these annular elements.

By the fact that pistons 28*a*' to 28*d*' are spaced from each other by dividing elements 140 to 146, pistons 28*a*' to 28*d*' are, kinematically, independent of each other. That means that the to-and-fro pivot movements of single pistons 28*a*' to 28*d*' are solely transmitted by the guiding of pistons 28*a*' to 28*d*' along the cam piece 48'.

Dividing elements 140 to 146 have two sliding surfaces 148 and 150, as shown exemplary in dividing element 140, on which piston fist surfaces 152 (piston 28*a*') and 154 (piston 28*b*') of the two respective pistons 28*a*' and 28*b*' slide to and fro in their pivot movement, the pistons 28*a*' and 28*b*' being in touch with dividing element 140.

Figure 5A:
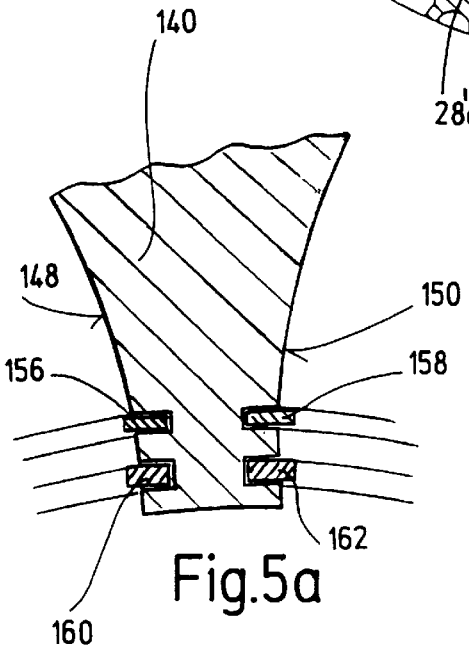
FIG. 5*a* shows a detail from FIG. 5 in enlarged scale.

In FIG. 5*a*, a sector of dividing element 140 is shown in an enlarged scale. In sliding surfaces 148 and 150, seals are embedded in dividing element 140, namely fire seals 156 and 158, which are arranged closer to the housing inner wall 14', as well as two oil seals 160 and 162, which are arranged closer to the cam piece 48'.

Fire seals 156 and 158 seal the work chambers 42' gas-tight into the direction of the longitudinal center axis of oscillating-piston engine 10', while oil seals 160 and 162 provide for a sealing of the housing-fixed oil space against work chambers 42'.

Seals 156 to 162 also extend over the complete axial length of dividing elements 140 to 146.

By the equipment of oscillating-piston engine 10' with dividing elements 140 to 146, nearly classical piston seals can be provided, the sealing effects of which can be predetermined with high certainty.

According to FIG. 6, fire seals 156 and 158 and oil seals 160 and 162 are, in dividing elements 140 to 146, on the same level, where the fire seals and the oil seals are located in annular elements 92' and 94' and/or 96', as indicated in FIG. 6 with the numeral reference 164.

While the sealings are arranged in dividing elements 140 to 146 themselves in the embodiment shown, according to FIGS. 4 to 6, the sealings can be arranged, however, also in piston fist surfaces 152 and/or 154 of pistons 28*a*' to 28*d*'.

As can be further taken from FIGS. 5 and 6, sliding surfaces 148 and 150 of dividing elements 140 to 146 are arranged in a concavely curved manner, while piston fist surfaces 152 and 154 of pistons 28*a*' to 28*d*' are arranged in a convexly curved manner, complementary to them. In that way, piston fist surfaces 152 and/or 154 of pistons 28*a*' to 28*d*' are always conducted with a minimal distance by sliding surfaces 148 and/or 150 of dividing elements 140 to 146 in their to-and-fro pivot movement.

What is claimed is:

1. An oscillating-piston engine, comprising:

a housing having a central housing axis and a housing inner wall;

several pistons configured as two-armed levers, said pistons being arranged in said housing and moving/orbiting together in a revolution direction about said central housing axis;

several pivot axes parallel to said housing axis, each of said pistons arranged pivotably about one of said pivot axes, respectively;

a stationary cam piece with respect to said housing and arranged centrally in said housing, said cam piece having an outer contour and at least one inner contour, said outer contour and said inner contour being configured as control cams, wherein said pistons have, at a side facing away from said housing inner wall, running surfaces, which are guided alongside said inner contour supportedly to a side of a centrifugal force and alongside said outer contour supportedly into a direction of the housing axis, in order to control pivot movements of said pistons in the revolution about said central housing axis.

2. The oscillating-piston engine of claim 1, wherein said outer contour and said inner contour run parallel to each other.

3. The oscillating-piston engine of claim 1, wherein said inner contour is configured continuous in said revolution direction.

4. The oscillating-piston engine of claim 1, wherein said inner contour extends only over one or more circumferential sections in said revolution direction.

5. The oscillating-piston engine of claim 1, wherein said cam piece has said outer contour and said at least one inner contour in a one-piece configuration.

6. The oscillating-piston engine of claim 1, wherein said cam piece is configured in several parts, wherein at least a first part has said outer contour and at least a second part said at least one inner contour, and said parts are firmly connected to each other.

7. The oscillating-piston engine of claim 1, wherein said inner contour is arranged on an inner side of a bag-like flange of said cam piece.

8. The oscillating-piston engine of claim 1, wherein said cam piece, in a region of both axial ends of said pistons, respectively, has, axially limited, said inner contour.

9. The oscillating-piston engine of claim 1, wherein each piston has at least two running surfaces, of which at least one is guided at said inner contour, while said at least another running surface is guided at the outer contour.

10. The oscillating-piston engine of claim 1, wherein said running surfaces are surfaces of rollers being rotatably mounted on said pistons.

11. The oscillating-piston engine of claim 1, wherein said pistons are, respectively in pairs, in rolling engagement with each other.

12. The oscillating-piston engine of claim 11, wherein said pistons are, respectively in pairs, in rolling engagement with each other via an unteethed curved rolling surface.

13. The oscillating-piston engine of claim 1, wherein said pistons, being in a circumferential direction, are spaced, respectively, in pairs via a respective dividing element, wherein said dividing elements revolve together with said pistons in the housing.

14. The oscillating-piston engine of claim 13, wherein each dividing element has two sliding surfaces, on which piston fist surfaces of two respective corresponding pistons, which are adjacent to said respective dividing element, slide to and fro during the pivot movements.

15. The oscillating-piston engine of claim 14, wherein said piston fist surfaces of said pistons and said sliding surfaces of said dividing elements are configured curvedly complementary to each other.

16. The oscillating-piston engine of claim 15, wherein in each sliding surface of said dividing elements, respectively, at least one seal is arranged.

17. The oscillating-piston engine of claim 16, wherein in each sliding surface a fire seal nearer to said housing inner wall and an oil seal nearer to said cam piece is arranged.

18. The oscillating-piston engine of claim 1, wherein it has several chambers in an axial direction, wherein in each chamber a set of the pistons is arranged, and wherein said sets of the pistons are displaced to each other from one chamber to the other chamber in a circumferential direction.

* * * * *